US006196110B1

(12) United States Patent
Angué

(10) Patent No.: US 6,196,110 B1
(45) Date of Patent: Mar. 6, 2001

(54) LINEAR DRIVE

(75) Inventor: Eric Angué, Stuttgart (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/366,468

(22) Filed: Aug. 3, 1999

(30) Foreign Application Priority Data

Aug. 14, 1998 (DE) ..... 298 14 578 U

(51) Int. Cl.[7] ..... F01B 29/00
(52) U.S. Cl. ..... 92/88; 92/169.1
(58) Field of Search ..... 92/88, 165 R, 92/165 PR, 166, 167, 168, 169.1

(56) References Cited

U.S. PATENT DOCUMENTS 5,473,971 12/1995 Takeuchi et al. .
5,507,218 4/1996 Lipinski .
5,701,798 12/1997 Noda .

*Primary Examiner*—Edward K. Look
*Assistant Examiner*—Hermes Rodriguez
(74) *Attorney, Agent, or Firm*—Hoffman & Baron, LLP

(57) ABSTRACT

A linear drive comprising a housing, which possesses a cylinder barrel having a longitudinal slot. The interior space of such cylinder barrel is closed by closure plugs axially inserted into the interior space. At the region facing the longitudinal slot the closure plug is provided with a flat, at which it engages the internal face of a sealing tape associated with the longitudinal slot in a fashion preventing relative rotation. The closure plug is anchored by a securing pin on the cylinder barrel.

18 Claims, 3 Drawing Sheets

LINEAR DRIVE

BACKGROUND OF THE INVENTION

The invention relates to a linear drive comprising an elongated housing, which possesses a cylinder barrel having a longitudinal slot at one position on its periphery, the interior space of such cylinder barrel being closed at both ends thereof by end caps, of which at least one is designed in the form of a closure plug inserted in the interior space at the end, and further comprising a sealing tape extending in the interior space along the longitudinal slot, such tape axially overlapping at least one closure plug at its exterior periphery.

THE PRIOR ART

A linear drive of this type is for example disclosed in the U.S. Pat. No. 5,701,798. Here it is a question of a linear drive without a piston rod, which comprises a drive part movingly supported in the interior space of the cylinder barrel and which is coupled via an entraining member, which extends through a longitudinal slot in the cylinder barrel, with an external output drive part kinematically. For sealing off the longitudinal slot a sealing tape is provided inside the interior space to extend along the longitudinal slot and is able to rest against sealing faces on the cylinder barrel and arranged adjacent to the flanks of the slot. This sealing tape is terminally secured at the end to the cylinder barrel, it overlapping the closure plug which closes the interior space of the cylinder barrel at the end. The closure plugs are inserted in the interior space for a great part of their length and are fixed in place by externally mounted plate elements.

The known linear drive does suffer from the disadvantage of having a relatively complex fixing means for the closure plugs delimiting the internal space axially. The closure plugs comprise a radially projecting flange and are firstly inserted so far into the internal space that the flange abuts the terminal face of the cylinder barrel. Following this the plate elements are put on and fixed in relation to the cylinder barrel. Finally using clamping screws anchored in the plate elements an axial force is exerted on the closure plugs so that the flange thereof is thrust against the terminal face of the cylinder barrel. Owing to the plate elements so put in place the axial dimensions of the linear drive are unnecessarily increased.

Accordingly one object of the present invention is to provide a linear drive of the initially described type which while ensuring reliable fixing in place of the sealing tape renders possible simple terminal closure of the interior space while ensuring compact longitudinal dimensions.

In order to achieve these and/or other objects appearing from the present specification, claims and drawings, in the present invention the closure plug possesses a flat on the part of its external periphery facing the longitudinal slot, such flat providing a rotational locking effect by engaging the facing internal surface of the sealing tape, the plug being anchored in the cylinder barrel by means of at least one securing pin fitting both into the cylinder barrel and also in the respective closure plug itself, such pin extending athwart the longitudinal direction of the interior space.

In this manner a linear drive is produced, in the case of which no attachment means extending out axially past the cylinder barrel are necessary in order to secure an end plate designed in the form of a closure plug on the cylinder barrel. The closure plug may be completely received in the interior space of the cylinder barrel, at least one securing pin being provided for fixing in position, which pin fits both into the cylinder barrel and also into the closure plug and may be inserted extremely simply without needing much space. In this connection the cooperation of the peripheral flat on the closure plug with the facing internal face of the sealing tape brings about an effect preventing relative rotation of the closure plug so that same may only be inserted with a specific angular alignment into the interior space and therefore automatically assumes a possibly necessary angular alignment for cooperation the securing pin. The angular presetting of position is for example an advantage as well if the interior space is to be supplied through a closure plug with a drive fluid and for this purpose a fluid duct present in the cylinder barrel must assume a position aligned with a fluid duct extending in the cylinder barrel.

Further advantageous developments of the invention are defined in the claims.

It is convenient for an engagement zone provided on the closure plug for the securing pin to be formed by a peripheral groove, which extends over part of the periphery of the closure plug and for example is designed like a notch or a cut. In connection with this it is an advantage if the engagement zone to be located in the peripheral region of the closure plug diametrally opposite the flat. Owing to the measures taken to prevent relative rotation by the cooperation between the flat and the sealing tape it is possible to ensure in this case that the closure plug may only be so inserted in the interior space that the engagement zone provided on it is automatically positioned in the correct setting in relation to the engagement zone, present on the cylinder barrel, for the securing pin. Assembly is now made extremely simple.

In order to be able to position the closure plug, which preferably has no abutment defining the desired depth of insertion, at the desired depth of the penetration in the interior space, it is possible for a recess to be provided on the axial external end of the closure plug, in which recess an assembly tool may be inserted temporarily, and by means of which an axial displacing force may be exerted on the closure plug. It is convenient for such recess to be in the form of a threaded hole such that it may render possible temporary screwing in of the threaded shank provided on the assembly tool, the assembly tool being in the simplest case a commercially available screw.

It is furthermore an advantage for the sealing tape to be fixedly clamped between the flat on the closure plug and at least one clamping face on the cylinder barrel and opposite to the flat for securing the sealing tape to the cylinder barrel. In this respect it is possible the clamping face to be provided on a clamping part fixed externally on the cylinder barrel, such clamping part spanning the longitudinal slot and acting on the external face, turned away from the closure plug radially, of the sealing tape.

In the case of a preferred structure the longitudinal slot has the terminal section, which overlaps the longitudinal slot axially, extending though it completely in the depth direction. In this case the arrangement may be such that the sealing tape projects outward radially to a small extent prior to fitting the clamping part past the cylinder barrel and after fitting the clamping part is acted upon by same and is firmly held between the clamping face and the flat on the closure plug. The clamping part itself may in this case be held by the elastic return force of the sealing tape, which is biased, in position so that it is unnecessary to provide any additional, elaborate measures for fixing the clamping part in place which is more especially plate-like.

A particularly reliable and axially firm means of attachment for the sealing tape is possible if the closure plug has superficial irregularities at its flat, such irregularities being able to come into engagement with the internal face of the sealing tape. This means that it is possible to produce an interlocking connection in addition to the clamping engagement. The superficial irregularities are more especially in the form of teeth.

The linear drive is more particularly a fluid operated structure, an axially moving drive part being arranged in the interior and coupled with an external output drive part, the drive part being in the form of a piston and being coupled with the output drive part via an entraining member extending through the longitudinal slot.

Finally it is to be pointed out that the clamping of the sealing tape between the flat and a clamping part on the cylinder barrel may be employed in connection with closure plugs, which are secured by different measures to the above mentioned use of a pin acting on the cylinder barrel.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
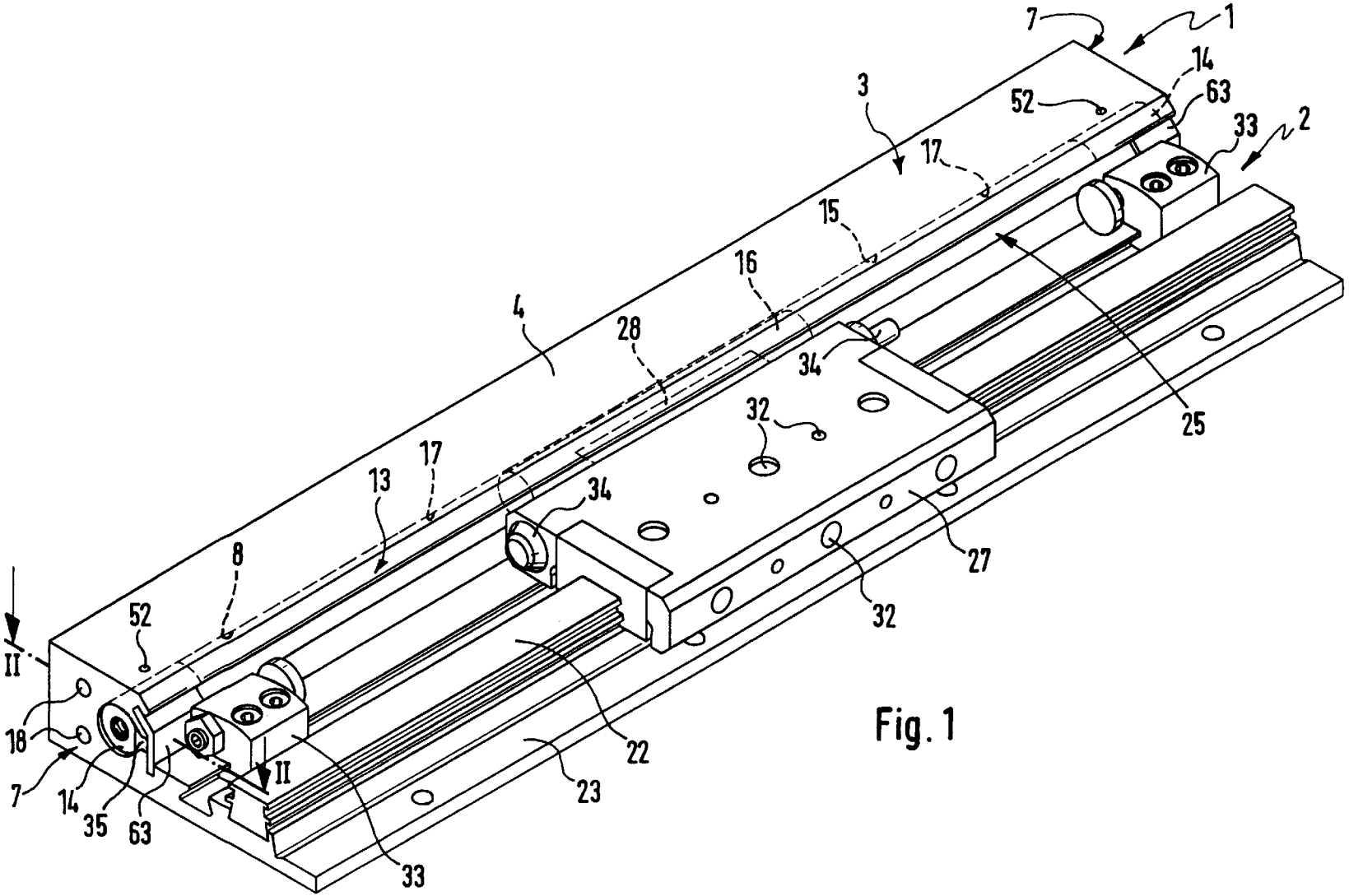
FIG. 1 shows a preferred embodiment of the linear drive of the invention in a perspective representation.
Figure 2:
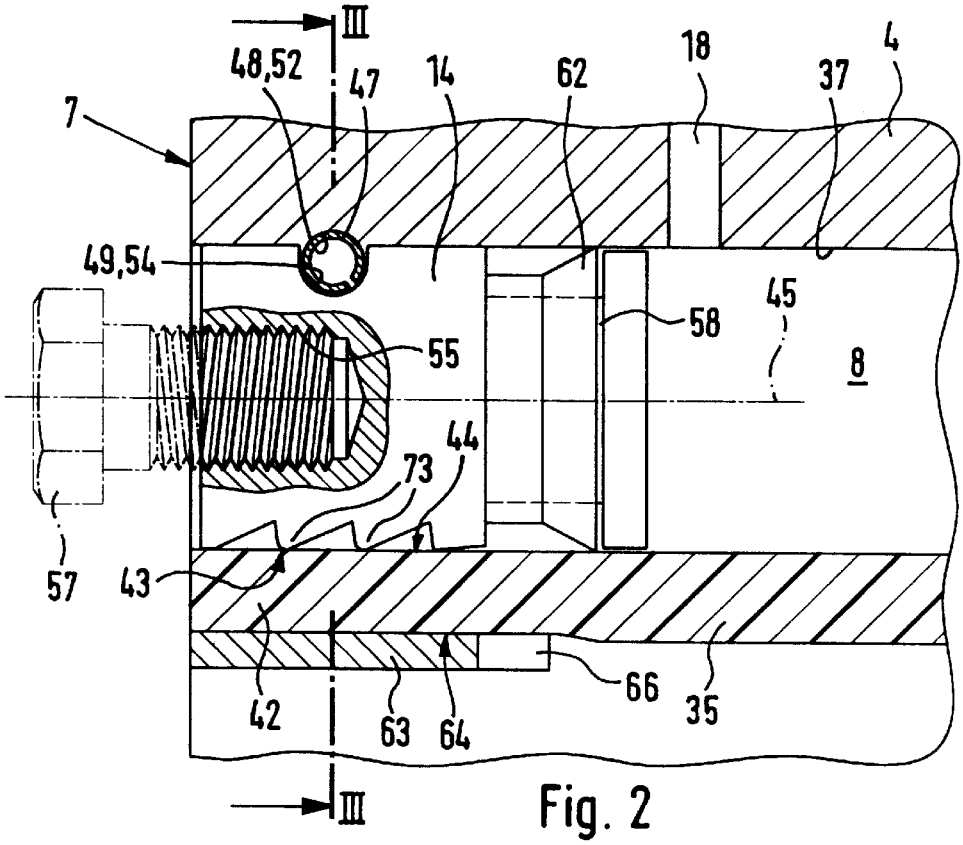
FIG. 2 shows a terminal section of the linear drive of FIG. 1 adjacent to a closure plug as seen in longitudinal section taken on the line II—II of FIGS. 1 and 3 on a larger scale.
Figure 3:
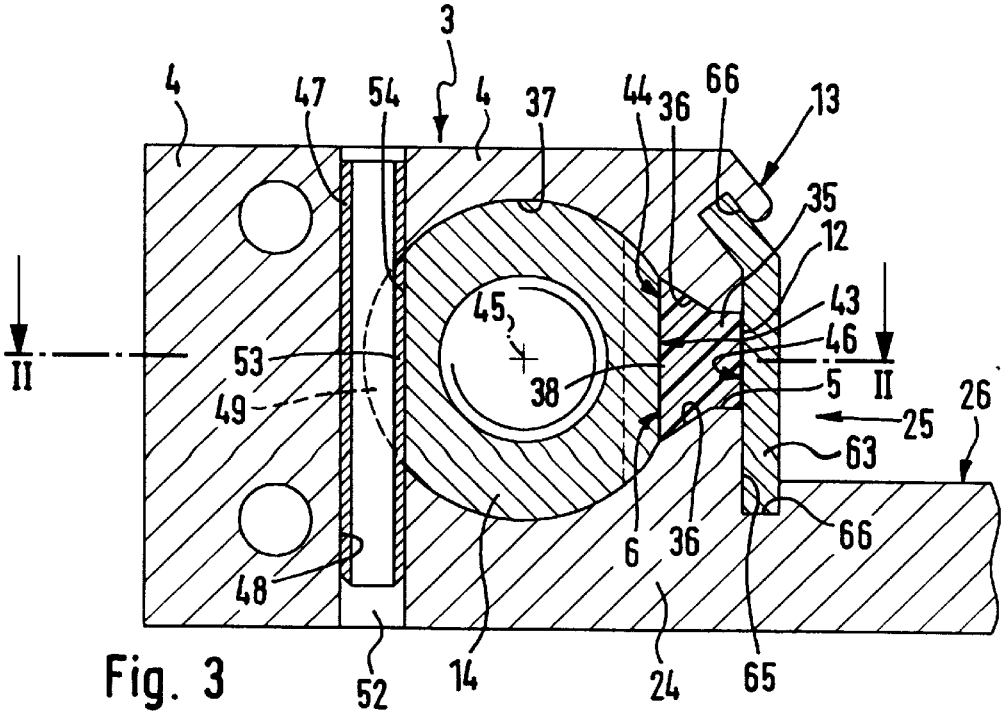
FIG. 3 shows a cross section taken through the arrangement of FIG. 2 taken on the section line III—III.
Figure 4:
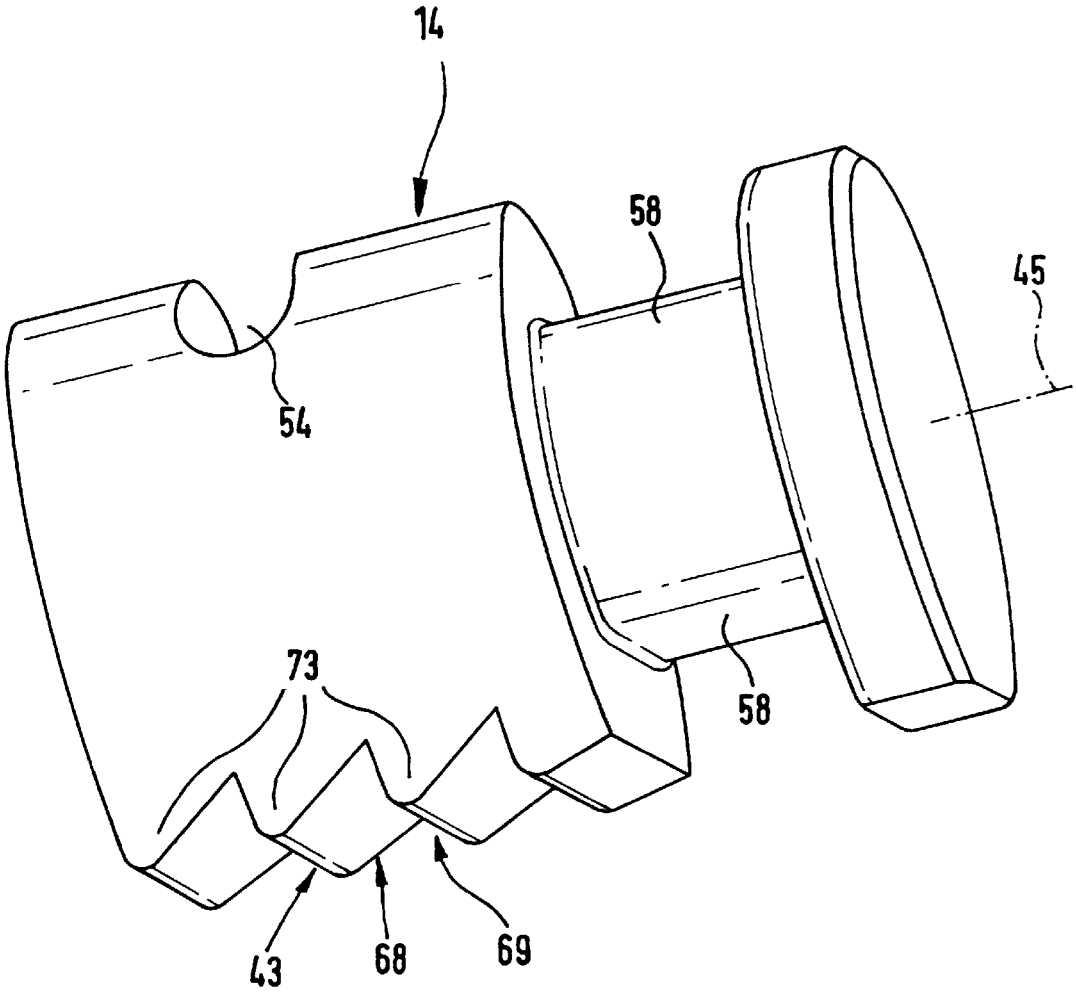
FIG. 4 shows the closure plug employed in the embodiment of the invention in a perspective separate view.

FIG. 1 shows a piston rod-less linear drive, which comprises a drive unit 1 and a guide unit 2. As shown in FIG. 3 the drive unit 1 comprises an elongated housing 3, which has a cylinder barrel 4, which at one point on its periphery has a longitudinal slot 5. The longitudinal slot 5 extends along the entire length of the cylinder barrel 4, it being open at the end toward the axially oppositely facing terminal faces 7 of the cylinder barrel 4.

In the interior of the cylinder barrel there is a cylindrical interior space 8 extending in the longitudinal direction and which also extends along the entire length of the cylinder barrel 4. The longitudinal slot 5 extends through the wall of the cylinder barrel 4 radially so that it opens on the longitudinal side on the one hand at an interior slot opening 6 toward the interior space 8 and on the other hand at an exterior slot opening 12 at the external face 13 of the cylinder barrel 4.

At its two ends the interior space 8 is closed off by end plates, which are in the form of closure plugs 14 and are inserted coaxially into the interior space 8. This means that a receiving space 15 is defined in the cylinder barrel 4, which contains a drive part 16 which is only diagrammatically indicated in FIG. 1 and which may be moved by the action of a force in the longitudinal direction of the receiving space 15. The drive part 16 in the embodiment of the invention is constituted by a piston, which bears sealing means, not illustrated, so that the receiving space 15 is divided into two working spaces 17 in a sealing fashion, such spaces being sealed off at the end remote from the drive part 16 by a respective closure plug 14. In the cylinder barrel 4 fluid ducts 18 extend and open into the working spaces 17 and render possible, as necessary, the supply and removal of a working fluid which is more particularly compressed air, in order to exert a fluid force on the drive part 16, this leading to a linear displacement of the drive part in the one or the other direction.

In the case of a further possible embodiment, not illustrated, the displacement of the drive part 16 is caused by an electric motor, for instance by having a lead screw extending in the interior space 8 so that such lead screw may be caused to rotate by an electric motor.

The guide unit 2 comprises a longitudinal guide 22, which is more especially in the form of a rail and extends in parallelism to the longitudinal direction of the interior space 8. It is fixedly connected to the cylinder barrel 4 and could be directly fixed to the latter. In the illustrated working embodiment it is provided on a plate-like carrying element 23, which is fixed to the cylinder barrel 4, preferably by being integral with it in construction. This latter possibility leads the way to extremely simple manufacture of the cylinder barrel 4 and the carrying element 23 by extrusion, more particularly of aluminum material.

It is furthermore an advantage if the plate-like carrying element 23 is formed as an extension of the one (24) of the two wall sections of the cylinder barrel 4, which constitute the two slot flanks of the longitudinal slot 5. Accordingly the carrying element 23 extends past the first longitudinal side 25, having the longitudinal slot 5, of the cylinder barrel 4 and the longitudinal guide 22 is located opposite this first longitudinal side 25, it conveniently being provided on the top plate face 26, facing the longitudinal slot 5, of the carrying element 23.

In the embodiment of the invention an output drive part 27, constituted by a slide, is mounted in a longitudinally moving manner in longitudinal guide 22, the longitudinal guide 22 being able to take up an transverse forces exerted by the output drive part 27.

The drive part 16 is kinematically coupled with the output drive part 27 by means of an entraining member 28, which extends through the longitudinal slot 5. The three above mentioned components accordingly constitute a common linearly moving unit. Attachment means 32 provided on the output drive part 27 render possible the attachment of one or more objects or components to be moved, the driving force being caused via the drive part 16 able to be moved by the action of force.

In the path of motion of the output drive part 27 abutment means 33 are provided axially on either side, which limit the stroke of the output drive part 27 and are preferably able to be adjusted in the longitudinal direction of the guide unit 2. In order to reduce the intensity of the impact the output drive part 27 is provided with buffer or shock absorber means 34, which may cooperate with the abutment means 33.

For providing a fluid seal for the longitudinal slot 5 in the interior space 8 in the cylinder barrel 4 a sealing tape 35 is provided axially on either side of the drive part 16, such tape extending along the longitudinal slot 5. It is more particularly so designed that it has elastic and more particularly rubber-like elastic properties. Axially on either side of the output drive part 27 it engages strip-like sealing faces 36 provided on the cylinder barrel adjacent to the flanks of the longitudinal slot 5, such sealing faces extending in parallelism to the longitudinal slot 5. Adjacent to the drive part 16 the sealing tape 35 is lifted clear of the sealing faces 36 by means of a guide faces provided on the drive part 16 and/or on the entraining member 28 so that the entraining member 28 may extend through the longitudinal slot 5.

The two sealing faces 36 are preferably immediately adjacent to the cylindrical internal face 37 of the interior space 8 and, turned toward one another, are so engaged with each other, more particularly so that they delimit a cross section which tapers in a radially inward direction. The sealing tape 35 cooperating with the sealing faces 36 has a sealing region 38, which is complementary and for example essentially trapezoidal, which extends into this cross section part.

The attachment of the sealing tape 35 on the cylinder barrel 4 is performed using the respectively associated closure plug 14. The latter is plugged into the interior space 8 for its entire length and thus assumes a position in which it is completely sunk into it. The associated end section 42 of the sealing tape 35 in this case overlaps the closure plug 14 at its outer periphery and practically assumes a position between the closure plug 14 and the region, defining the longitudinal slot 5, of the wall of the cylinder barrel 4.

Since the closure plug 14 has a flat 43 on the part of its outer periphery facing the longitudinal slot 5, it having such flat in engagement with the facing internal face 44 of the adjacent end section 42 of the sealing tape 35, it is fixed in relation to the cylinder barrel 4 along its longitudinal axis 45, coinciding with the longitudinal axis of the interior space 8, to prevent relative rotation. Simultaneously the said end section 42 is firmly clamped in place between the flat 43 and a radially external clamping face 46, which is opposite to the flat 43. The closure plug 14 therefore has a double function as a closure means in relation to the interior space 8 and a fixing means for the sealing tape 35.

The above described measure for preventing rotation renders possible axial introduction from the end of the closure plug 14 into the interior space 8 with a predetermined anglar setting about the longitudinal axis 45. This again favors the attachment of the closure plug 14 on the cylinder barrel 4, something which in the embodiment of the invention is performed using a pin for fixation. At least one and preferably just one securing pin 47 is provided, which extends athwart the longitudinal axis 45 of the interior space 8 and which fits both in the cylinder barrel 4 and also into the associated closure plug 14, more particularly in an interlocking manner capable of transmitting force.

The securing pin 47 is preferably set with a bias in a force resisting manner in a first engagement zone 48 on the cylinder barrel and/or in a second engagement zone 49 on the closure plug. The securing pin 47 may more particularly be a spring pin, which is conveniently made hollow and has a longitudinal slot.

The first engagement zone 48 provided on the cylinder barrel is preferably formed by a transverse hole 52 which so extends in the cylinder barrel 4 that it meets or intersects the terminal section of the interior space 8 adjacent to the closure plug 14. The securing pin 47 inserted into the transverse hole 52 therefore has at least one section 53 of its periphery, like the run of a secant, into the interior space 8. The transverse hole 52 is more especially designed in the form of a through hole extending between the opposite outer faces of the cylinder barrel 4 so that the inserted securing pin 47 may be removed as required extremely simply by the use of a commercially available percussion tool.

The second engagement zone 49 provided on the closure plug is in the embodiment constituted by a peripheral groove 54 extending over only part of the periphery of the closure plug 14. It is aligned with the transverse hole 52 so that the above mentioned peripheral section 53, extending into the interior space 8, of the securing pin 47 fits into this peripheral groove 54. It is in this manner that the closure plug 14 is prevented from moving axially and in addition conveniently prevented from rotating about its longitudinal axis 45.

It is convenient for the second engagement zone 49, provided on the closure plug 14, to be located in that peripheral region, which is opposite to the flat 43 diametrally. The geometry of the flat 43 is accordingly not impaired by measures taken for anchoring the closure plug 14.

In order to be able to readily position the closure plug 14 at the appropriate axial depth within the interior space 8 so that the two engagement zones 48 and 49 correlate with each other, each closure plug 14 possesses an axial recess 55 on its outer side axially opposite to the receiving space 15, in which recess a suitable assembly tool may be releaseably fixed. In the illustrated working embodiment the recess 55 is designed in the form of a threaded hole and renders possible the screwing in of an assembly tool 56, indicated in chained lines, provided with a screw shank. By grasping the handle section 57, extending out of the recess 55, it is now possible to position the closure plug 14 in an extremely simple manner. After this it is possible for the assembly tool 56 to be removed again. In the case of a particularly cheap design the assembly tool 56 is constituted by a commercially available screw, whose head can be employed for handling at 57.

The closure plug 14 furthermore bears an annular sealing ring 62 coaxially on the a suitably design holding section 58, such sealing ring being in abutment with the internal delimiting wall face 37 of the interior space 8 and the interior face 44 of the end section 42 of the sealing tape 35 in order to prevent escape of pressure medium from the interior space 8 at the end.

In the illustrated working embodiment the terminal section 42 of the sealing tape 35 is fixed in place in a special manner without using screws. The measure employed can be also used in the case of such closure plugs 14, which are fixed in a different fashion, i. e. without using pins, on the cylinder barrel 4. As regards details there is a clamping part 63 fixed to the cylinder barrel 4, such part 63 being more particularly in the form of a plate, such clamping part 63 spanning the longitudinal slot 5 adjacent to its outer slot opening 12 and thereby acting at a clamping face 46, covering over the outer slot opening 12, on the facing outer face 64 of the terminal section 42 so that the same is fixedly clamped between the flat 43 and the clamping face 46.

This attachment measure is particularly suitable in cases wherein the height of the sealing tape 35 is so selected that it extends completely through the longitudinal slot 5 in the depth direction. In this case it is unnecessary to provide a special design of the clamping part 63 so that the clamping face is provided on a projection extending from the outside into the longitudinal slot 5. The clamping face may be directly formed by a flat face, spanning the longitudinal slot, on the clamping part 63 as is indicated in FIG. 3.

It is convenient for the arrangement to be such that prior to fitting the clamping part 63 the sealing tape extends a certain distance radially outward past the outer slot opening 12. The clamping part 63, which is fitted later, will then assume a position with its clamping face 46 aligned with the outer slot opening 12 and accordingly causes a radially directed biasing force, that is to say a force in the depth direction of the longitudinal slot 5, on the sealing tape 35 so that same is reliably held.

Simultaneously in the embodiment the return force, resulting from the bias of the elastically deforming sealing tape 35, is employed to fix the clamping part 63 in place. The latter is inserted axially into a receiving pocket, open toward the adjacent terminal face 7, in the cylinder barrel 4 so that it assumes a position externally on the cylinder barrel 5 adjacent to the outer slot opening 12. The said receiving pocket 65 is in the embodiment formed by two spaced apart opposite longitudinally extending groove-like recesses 66 and 67, into which marginal sections on the longitudinal sides of the plate-like and if necessary cranked clamping part 63 may fit. Owing to the elastic return force of the sealing tape 35 the clamping part 63 is thrust against the flanks of the groove-like recesses 66 and 67 and consequently held fast.

The insertion of the clamping part 63 is conveniently performed while the sealing tape 35 is extending some distance out past the terminal face 7, the sealing tape 35 being cut to the right length after fitting of the clamping 63 at the terminal face 7.

In order to ensure reliable holding of the sealing tape 35 even when it is subjected to a high tension force, the flat 43, as illustrated, may be provided with superficial irregularities 68, which may engage the internal surface 44 of the sealing tape 35 and thereby effect an additional interlocking anchoring action. In the design provided in the embodiment the superficial irregularities 68 are constituted by teeth 69, comprising a plurality of individual tooth means 73 extending athwart the longitudinal direction 45 of the closure plug 14. The tooth means may bite into the surface of the sealing tape 35 with a deformation thereof and produce a high resistance to pulling forces.

What is claimed is:

1. A linear drive comprising an elongated housing, which possesses a cylinder barrel having a longitudinal slot at one position on its periphery, the interior space of such cylinder barrel being closed at both ends thereof by end caps, of which at least one is designed in the form of a closure plug inserted in the interior space at the end, and further comprising a sealing tape extending in the interior space along the longitudinal slot, such tape axially overlapping at least one closure plug at its exterior periphery, wherein the closure plug possesses a flat on the part of its external periphery facing the longitudinal slot, such flat providing a rotational locking effect by engaging the facing internal surface of the sealing tape, the plug being anchored in the cylinder barrel by means of at least one securing pin fitting both into the cylinder barrel and also in the respective closure plug itself, such pin extending athwart the longitudinal direction of the interior space.

2. The linear drive as set forth in claim 1, wherein the engagement zone provided on the closure plug is constituted by a peripheral groove extending over only part of the periphery of the closure plug.

3. The linear drive as set forth in claim 1, wherein the engagement zone provided on the cylinder barrel for the securing pin is constituted by a transverse hole aligned with the engagement zone on the closure plug.

4. The linear drive as set forth in claim 1, wherein the engagement zone provided on the closure plug is located in the peripheral region, diametrally opposite to the flat, of the closure plug.

5. The linear drive as set forth in claim 1, wherein the closure plug is received in the interior space into which it is completely sunk.

6. The linear drive as set forth in claim 1, wherein on its axial outer side facing away from the the interior space, the closure plug possesses an axial recess, in which an assembly tool may be releaseably fitted, such tool serving for positioning the closure plug in the interior space.

7. The linear drive as set forth in claim 6, wherein the recess is in the form of a threaded hole, in which a fitting tool having a threaded shank and for instance in the form of a screw, can be fixed by screwing.

8. The linear drive as set forth in claim 1, wherein the sealing tape is firmly held between the flat provided on the closure plug and at least one clamping face on the cylinder barrel opposite to the flat.

9. The linear drive as set forth in claim 8, wherein one clamping face is provided on a clamping part spanning the longitudinal slot and fixed on the outer region of the cylinder barrel, such clamping part acting on the outer face radially turned away from the closure plug.

10. The linear drive as set forth in claim 9, wherein at least the terminal section, overlapping the closure plug, of the sealing tape completely extends through the longitudinal slot of the cylinder barrel in the depth direction.

11. The linear drive as set forth in claim 9, wherein from the associated end side of the cylinder barrel the clamping is axially inserted into a pocket provided on the cylinder barrel and is fixed therein, more especially by the sealing tape, which is biased.

12. The linear drive as set forth in claim 9, wherein the clamping part is plate-like in design.

13. The linear drive as set forth in claim 1, wherein the closure plug has superficial irregularities at its flat, such superficial irregularities being able to engaged the inner face of the sealing tape, which more especially has rubber-like properties.

14. The linear drive as set forth in claim 13, wherein the superficial irregularities are constituted by teeth.

15. The linear drive as set forth in claim 14, wherein the teeth comprises a plurality of tooth means arranged axially in sequence and extending athwart the longitudinal direction of the closure plug.

16. The linear drive as set forth in claim 15, comprising a drive part located in the interior space and able to be moved in the longitudinal direction, kinematically coupled through the longitudinal slot with the output drive part arranged outside the cylinder barrel.

17. The linear drive as set forth in claim 16, wherein the output drive part is designed in the form of a slide and is guided linearly for movement on a longitudinal guide arranged outside the interior space in parallelism to same.

18. The linear drive as set forth in claim 16, designed for fluid power operation, said drive part being constituted by a piston dividing up the interior space in a sealing fashion into two working spaces for receiving drive fluid.

* * * * *